US012611039B2

(12) United States Patent
Yan

(10) Patent No.: US 12,611,039 B2
(45) Date of Patent: Apr. 28, 2026

(54) SOFA SET CONVENIENT TO ASSEMBLE

(71) Applicant: Hangzhou Pinsong Technology Co., Zhejiang (CN)

(72) Inventor: Banggan Yan, Zhejiang (CN)

( * ) Notice: Subject to any disclaimer, the term of this patent is extended or adjusted under 35 U.S.C. 154(b) by 253 days.

(21) Appl. No.: 18/610,148

(22) Filed: Mar. 19, 2024

(65) Prior Publication Data

US 2025/0295240 A1 Sep. 25, 2025

(51) Int. Cl.

| | |
|---|---|
| ***A47C 4/02*** | (2006.01) |
| ***A47C 13/00*** | (2006.01) |
| ***A47C 15/00*** | (2006.01) |
| ***F16B 12/00*** | (2006.01) |
| *A47C 7/54* | (2006.01) |

(52) U.S. Cl.
CPC ..... *A47C 13/005* (2013.01); *A47C 15/002* (2013.01); *A47C 7/546* (2013.01)

(58) Field of Classification Search
CPC ..... A47C 13/005; A47C 17/02; A47C 4/028; A47C 17/04; A47C 17/86; A47C 1/02; A47C 17/00
See application file for complete search history.

(56) References Cited

U.S. PATENT DOCUMENTS

| | | | | |
|---|---|---|---|---|
| 1,657,285 | A * | 1/1928 | Siskin | A47C 7/34 5/252 |
| 2,128,912 | A * | 9/1938 | Buffington | A47C 4/10 297/60 |
| 2,751,969 | A * | 6/1956 | Kruijt | A47C 1/124 297/248 |
| 3,528,096 | A * | 9/1970 | Moberg | A47C 13/00 297/118 |
| 4,657,302 | A * | 4/1987 | Snyder | A47C 1/124 297/440.22 |
| 5,957,530 | A * | 9/1999 | Gutgsell | A47C 1/124 297/232 |
| 8,162,396 | B2 * | 4/2012 | Edwards | A47C 15/00 297/440.22 |
| 8,783,778 | B2 * | 7/2014 | Nelson | A47C 13/005 403/395 |
| 9,277,826 | B2 * | 3/2016 | Nelson | A47C 3/029 |
| 12,070,131 | B2 * | 8/2024 | Nelson | A47C 4/02 |
| 2006/0279124 | A1 * | 12/2006 | White, III | A47C 13/005 297/440.14 |

(Continued)

FOREIGN PATENT DOCUMENTS

| | | | | |
|---|---|---|---|---|
| CA | 3109177 | A1 * | 8/2021 | A47C 13/005 |

*Primary Examiner* — Shin H Kim
(74) *Attorney, Agent, or Firm* — Hawaii Patent Services; Nathaniel K. Fedde; Kenton N. Fedde

(57) ABSTRACT

A sofa set with convenient to assemble comprises a seat assembly and armrest frames, wherein the armrest frames are attached at both ends of the seat assembly; the seat assembly comprises a seat unit which comprises a seat frame and a seat cushion, and the seat cushion is arranged on the seat frame; the seat frame comprises a seat plate, wherein the seat plate comprises a first seat frame rod and a second seat frame rod, and corresponding fixing holes are arranged on the first seat frame rod and the second seat frame rod; it further comprises a connecting foot stand, wherein fixing holes corresponding to the second seat frame rod and the first seat frame rod are arranged on the connecting foot stand.

20 Claims, 19 Drawing Sheets

(56) References Cited

U.S. PATENT DOCUMENTS

| | | | | |
|---|---|---|---|---|
| 2011/0298340 | A1* | 12/2011 | Nelson | A47C 3/029 312/107 |
| 2012/0119629 | A1* | 5/2012 | Nelson | A47C 7/546 312/111 |
| 2014/0368010 | A1* | 12/2014 | Nelson | A47C 13/005 297/440.14 |
| 2016/0174715 | A1* | 6/2016 | Nelson | A47C 17/045 297/440.14 |
| 2016/0206100 | A1* | 7/2016 | Nelson | F16B 12/00 |
| 2017/0143122 | A1* | 5/2017 | Nelson | A47C 1/0352 |
| 2017/0150264 | A1* | 5/2017 | Nelson | H04R 5/023 |
| 2020/0060423 | A1* | 2/2020 | Ferguson | F16B 12/44 |
| 2020/0100030 | A1* | 3/2020 | Nelson | H04R 5/023 |
| 2020/0224693 | A1* | 7/2020 | Klingler | F16B 1/00 |
| 2020/0260877 | A1* | 8/2020 | Wu | A47C 4/03 |
| 2023/0138042 | A1* | 5/2023 | Lee | A47B 87/0276 312/111 |

* cited by examiner

SOFA SET CONVENIENT TO ASSEMBLE

TECHNICAL FIELD

The present invention relates to the technical field of home furnishing, in particular to a sofa set which is convenient to assemble.

BACKGROUND

At present, most sofa sets on the market adopt fixed design solutions, and their sizes cannot be adjusted according to users' needs. However, the indoor space structure of users is different, which makes it difficult for sofa sets in the market to adapt to different usage scenarios. In addition, the fixed sofa set also has many inconveniences in the process of handling and transportation, such as heavy weight, large volume and easy damage. Therefore, there is an urgent need for a sofa set that can be flexibly changed according to users' individual needs and indoor space structure, so as to meet the dual requirements of users' comfort and aesthetics, and also facilitate handling and transportation.

For example, a sofa set disclosed in the U.S. patent application Ser. No. 17/259,929 has the disadvantages of fixed size, inability to match the apartment structure of various users' houses, large volume of each component and inconvenient handling process; similarly, a sofa set disclosed in the U.S. patent application Ser. No. 14/331,595 also has the problems that the size cannot be adjusted, and it cannot be adapted to various apartment types, and the assembly process of the sofa set is cumbersome and inconvenient.

Therefore, it is necessary for us to put forward a brand-new sofa set. The overall size of the sofa set can be adjusted according to different apartment sizes, and the components are small in size, convenient to carry and simple in assembly process, which can provide users with sofa choices with more happiness.

SUMMARY

The present invention provides an assembly structure of a sofa set, which includes a plurality of seat plates;

wherein the seat plate includes a first seat frame rod and a second seat frame rod, wherein the first seat frame rod is provided with at least one fixing hole A, and the second seat frame rod is provided with at least one fixing hole B; and at least one connecting foot stand;

wherein the connecting foot stand is provided with a joint plate, at least one fixing hole C and at least one fixing hole D are provided on the joint plate; the first seat frame rod is provided with at least one fixing hole E, and the fixing hole E corresponds to the fixing hole C; the second seat frame rod is provided with at least one fixing hole F, and the fixing hole F corresponds to the fixing hole D; and wherein, when a plurality of seat plates are assembled, the seat plate and the other seat plate are fixed by a first fixing member, the seat plate and the connecting foot stand are fixed by a second fixing member, and the other seat plate and the connecting foot stand are fixed by a third fixing member.

The present invention provides a sofa set convenient to assemble, which includes a seat assembly and at least one armrest framework, wherein the armrest framework is detachably attached at both ends of the seat assembly; and the seat assembly includes at least one seat unit, wherein the seat unit includes a seat frame and a seat cushion, and the seat cushion is configured on the seat frame; and wherein, the seat frame includes a seat plate, and the seat plate includes a first seat frame rod and a second seat frame rod, wherein the first seat frame rod is provided with at least one fixing hole A, and at least one fixing hole B is arranged on the second seat frame rod, and the fixing hole A corresponds to the fixing hole B; and wherein, the sofa set further includes a connecting foot stand, wherein the connecting foot stand is provided with at least one fixing hole C and at least one fixing hole D; the first seat frame rod is provided with at least one fixing hole E, and the fixing holes E corresponds to the fixing hole C; and the second seat frame is provided with at least one fixing hole F, and the fixing hole F corresponds to the fixing hole D; and wherein, when a plurality of seat units are assembled, the seat unit and another seat unit are fixed by a first fixing member, the seat unit and the connecting foot stand are fixed by a second fixing member, and the other seat unit and the connecting foot stand are fixed by a third fixing member.

The present invention also provides a method for assembling the sofa set, which includes the following steps: providing a sofa set convenient to assemble;

wherein, the sofa set includes a seat assembly and at least one armrest framework, wherein the armrest framework is detachably attached at both ends of the seat assembly; and the seat assembly includes at least one seat unit, wherein the seat unit includes a seat frame and a seat cushion, and the seat cushion is configured on the seat frame; and wherein, the seat frame includes a seat plate, and the seat plate includes a first seat frame rod and a second seat frame rod, wherein the first seat frame rod is provided with at least one fixing hole A, and at least one fixing hole B is arranged on the second seat frame rod, and the fixing hole A corresponds to the fixing hole B; and wherein, the sofa set further includes a connecting foot stand, wherein the connecting foot stand is provided with at least one fixing hole C and at least one fixing hole D; the first seat frame rod is provided with at least one fixing hole E, and the fixing holes E corresponds to the fixing hole C; and the second seat frame is provided with at least one fixing hole F, and the fixing hole F corresponds to the fixing hole D; and the method includes the following steps:

placing the seat units to be assembled in a same direction, and fixedly connecting the seat units with another seat unit through a first fixing member;

configuring the connecting foot stand at a corresponding position of the seat assembly, and then fixedly connecting the connecting foot stand with the seat assembly through a second fixing member and a third fixing member; and attaching the armrest framework to both ends of the seat assembly.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
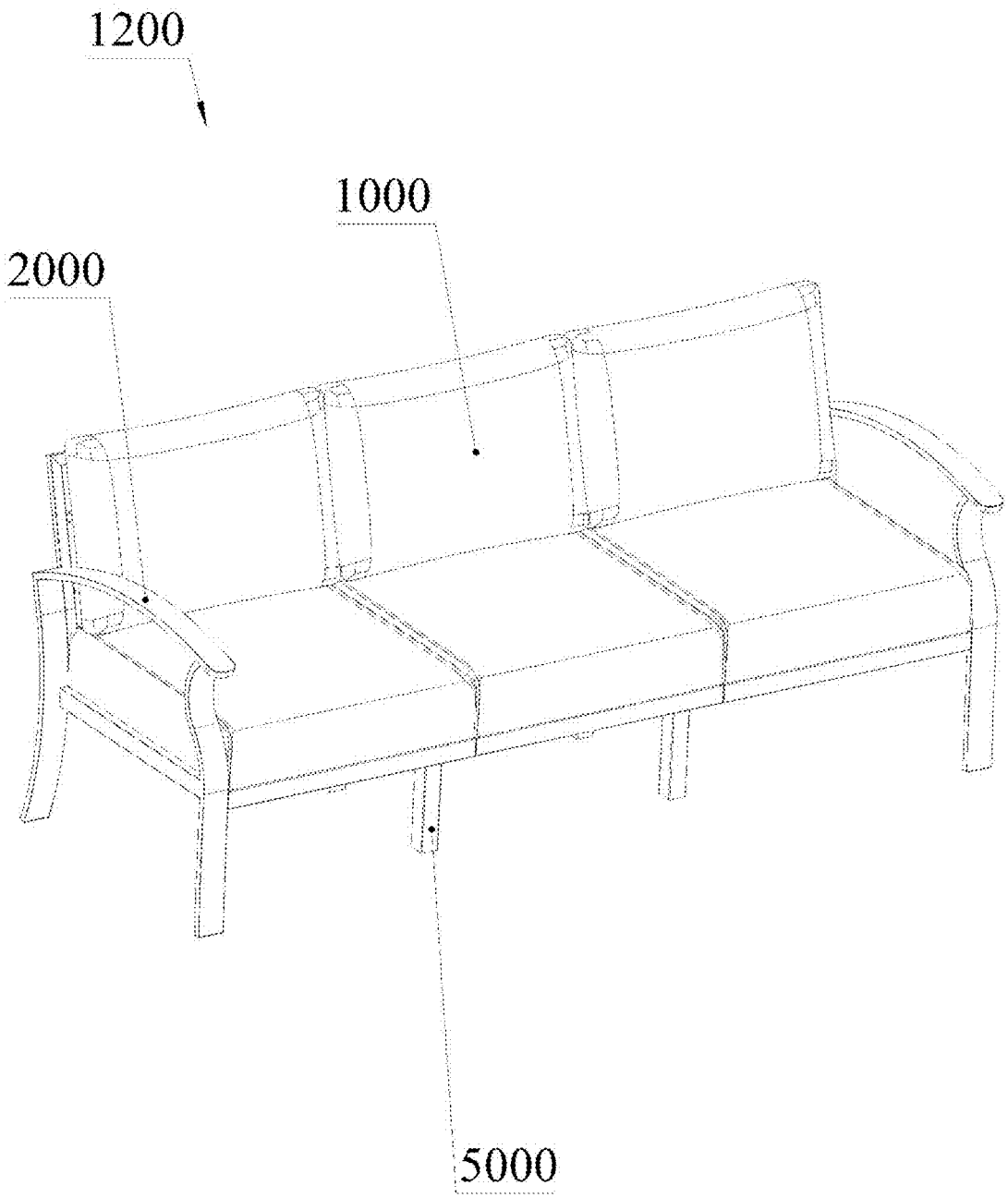
FIG. 1 is a schematic view of a sofa set.
Figure 2:
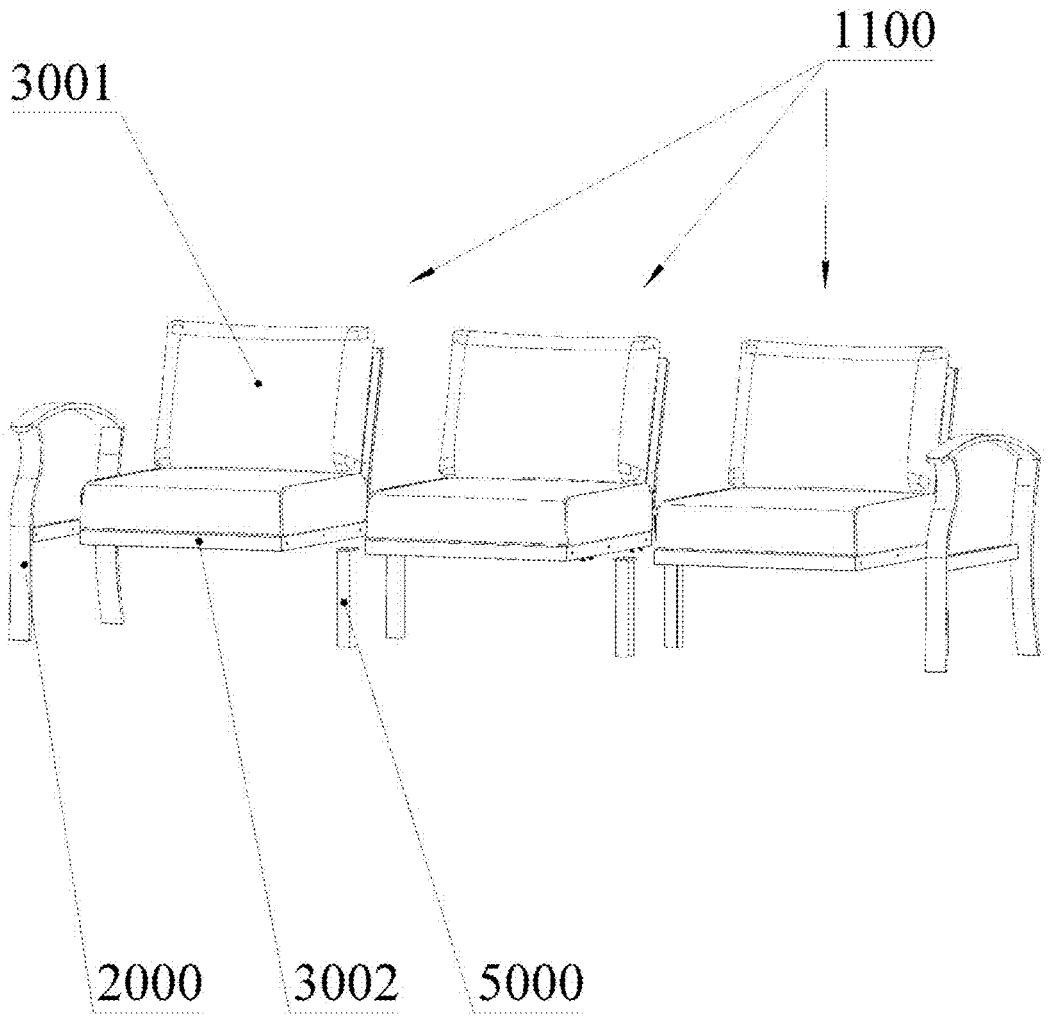
FIG. 2 is a partial exploded view of FIG. 1.
Figure 3:
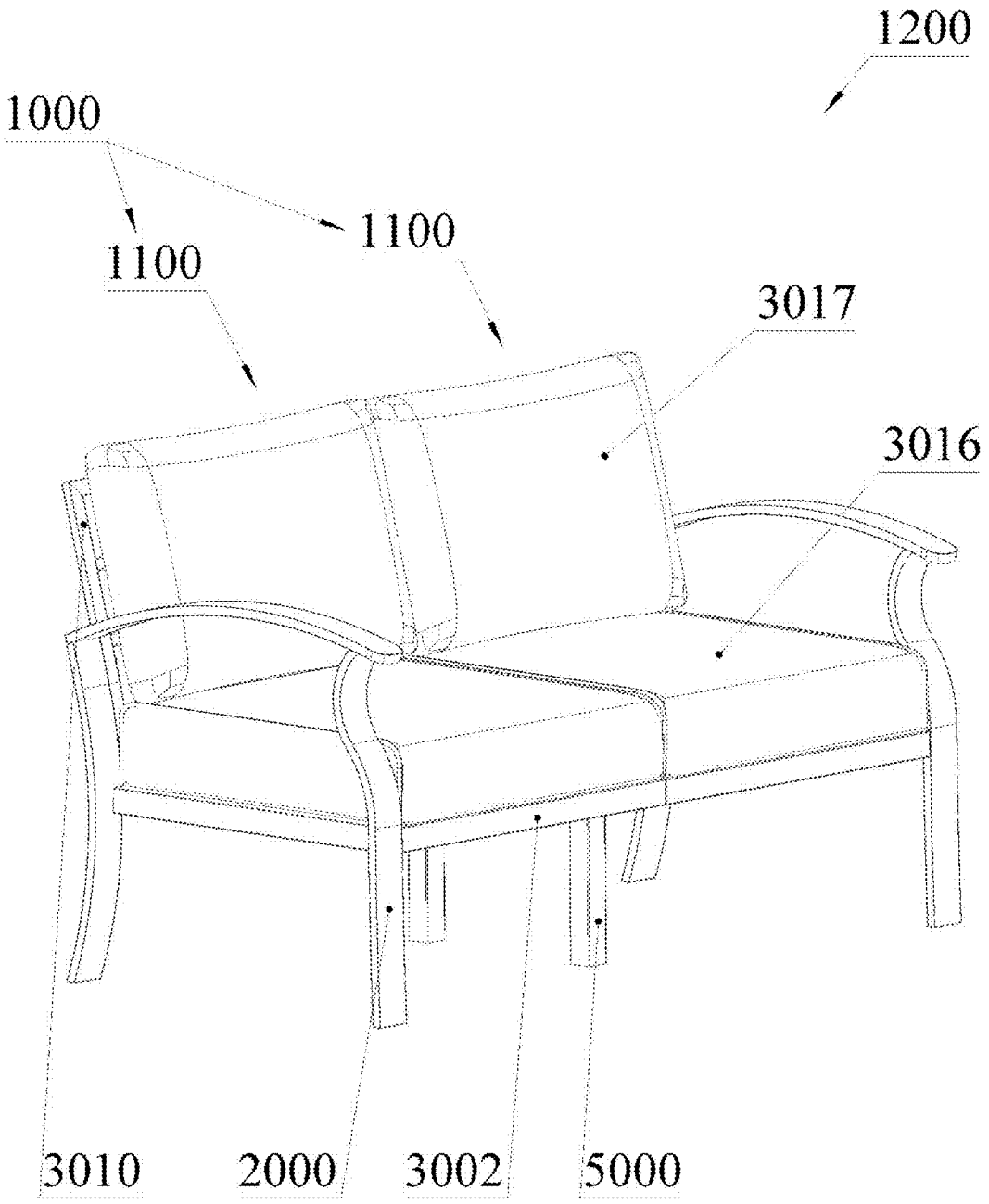
FIG. 3 is a schematic diagram of another embodiment 1 of the sofa set.

Seat assembly (1000); Seat unit (1100); Sofa set (1200); Armrest framework (2000); Armrest frame (2001); Middle cross rod (2002); First support leg (2003); Second support leg (2004); Armrest rod (2005); Seat frame (3000); Seat cushion (3001); Seat plate (3002); Seat frame (3003); Seat strut (3004); First seat frame rod (3005); Second seat frame rod (3006); Third seat frame rod (3007); Front end (3008); Rear end (3009); Seat back plate (3010); Seat back frame (3011); Seat back strut (3012); First seat back frame rod (3013); Second seat back frame rod (3014); Third seat back frame rod (3015); Cushion (3016); Back cushion (3017); Strap (3018); Fixing hole A (4000); Fixing hole B (4001); Fixing hole C (4002); Fixing hole D (4003); Fixing hole E (4004); Fixing hole F (4005); Fixing hole G (4006); Fixing hole H (4007); Fixing hole I (4008); Fixing hole K (4009); Fixing hole K (4010); Fixing hole L (4011); Connecting foot stand (5000); Joint plate (5001); Supporting foot (5002); First fixing member (6000); Second fixing member (6001); Third fixing member (6002); Fourth fixing member (6003); Fifth fixing member (6004); Sixth fixing member (6005); Seventh fixing member (6006); Corner joint frame (7000); First joint rod (7001); second joint rod (7002); Fixing hole Q (7003); Fixing hole R (7004); Eighth fixing member (7005); Corner joint plate (7006); Fourth seat frame rod (7007); Fixing hole S (7008); Ninth fixing member (7009); Fixing hole W (7010); Tenth fixing member (7011); Joint block (7012); Eleventh fixing member (7013); Fixing hole X (7014); Fixing hole Y (7015).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

In the following, the technical solution in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by ordinary technicians in this field without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIGS. 1 to 14, the present invention provides a sofa set which is convenient to assemble. The sofa set 1200 includes a seat assembly 1000 and at least one armrest framework 2000, and the armrest framework 2000 is detachably attached to both ends of the seat assembly 1000, thus providing a more flexible use mode for users.

The design of the sofa set takes into account the user's experience and adopts humanized design, which makes it more convenient and quick for users to assemble and disassemble the sofa set. In addition, the sofa set is made of high-quality materials, which has good durability and comfort, and can provide users with a more comfortable experience. In the future, the sofa set will be continually optimized and improved to meet the changing needs of users and provide them with better products and services.

In this embodiment, the sofa set includes two armrest frameworks 2000, which are attached to both ends of the seat assembly 1000. In other embodiments, the sofa set is not limited to two armrest frameworks, but can also be set to one, three, four, five and any desired number. This design can meet the different needs of users, for example, users can choose different number of armrest frames according to their own space size and home style to achieve the best use effect.

As shown in FIGS. 1 to 8, the seat assembly 1000 includes at least one seat unit 1100, which includes a seat frame 3000 and a seat cushion 3001, and the seat cushion 3001 is arranged on the seat frame 3000; the seat frame 3000 includes a seat plate 3002, which includes a first seat frame rod 3005 and a second seat frame rod 3006; the first seat frame rod 3005 is provided with at least one fixing hole A4000, and the second seat frame rod 3006 is provided with at least one fixing hole B 4001, and the fixing hole A 4000 corresponds to the fixing hole B 4001. Wherein, the seat assembly can be set as one, two, three, four, five, six and any number of seat units that meet the wishes. This design can meet the different needs of users, for example, users can choose different number of seating units according to their own space size and home style to achieve the best use effect.

In addition, the sofa set also includes a connecting foot stand 5000, on which a joint plate 5001 is arranged, and at least one fixing hole C 4002 and at least one fixing hole D 4003 are arranged on the joint plate 5001; at least one fixing hole E 4004 is arranged on the first seat frame rod 3005, and the fixing hole E 4004 corresponds to the fixing hole C 4002, and at least one fixing hole F 4005 is arranged on the second seat frame rod 3006, and the fixing hole F 4005 corresponds to the fixing hole D 4003.

Wherein, when a plurality of seat units 1100 are assembled, the seat unit 1100 and another seat unit 1100 are fixed by the first fixing member 6000; the seat unit 1100 and the connecting foot stand 5000 are fixed by the second fixing member 6001; and the other seat unit 1100 and the connecting foot stand 5000 are fixed by the third fixing member 6002.

This design can meet the different needs of users, for example, users can choose different number of seat units and armrest frames according to their own space size and home style to achieve the best use effect. In addition, the design of the sofa set takes into account the user's experience and adopts humanized design, which makes it more convenient and quick for users to assemble and disassemble the sofa set. Wherein, the seat bracket can adopt different materials and shapes to meet the different needs of users. In addition, seat cushions can also be made of different materials and colors to meet the different aesthetic needs of users.

In this embodiment, the seat unit and another seat unit, the seat unit and the connecting foot stand, and the other seat unit and the connecting foot stand are fixedly connected through fixing holes and fixing members. In other embodiments (not shown in the figure), the seat unit and another seat unit, the seat unit and the connecting foot stand, and the other seat unit and the connecting foot stand are not limited to being fixedly connected through fixing holes and fixing members, and other connection modes can also be adopted. For example, snap connection can be used, which can make the seat unit more firm and more convenient for disassembly and replacement. In addition, hook and loop connection can also be used, which can make the seat unit easier to disassemble and replace, and can also be adjusted as needed; in addition, it can be set to any desired connection mode.

This design can meet the different needs of users, for example, users can choose different connection methods according to their own space size and home style to achieve the best use effect. In the future, the sofa set will be continually optimized and improved to meet the changing needs of users and provide them with better products and services.

As shown in FIGS. 2 to 11, in this embodiment, the seat plate 3002 includes a seat frame 3003, and a plurality of seat struts 3004 are uniformly arranged in the seat frame 3003, wherein at least one reinforcing rod 3019 is further arranged below the seat struts 3004. This design can meet the user's demand for the stability and comfort of the seat. In other embodiments (not shown in the figure), the seat plate can also be arranged in a plate-like structure.

In this embodiment, a reinforcing rod is arranged below the seat strut. In other embodiments (not shown in the figure), it is not limited to providing only one reinforcing rod below the seat strut, but also two, three, four, five, six and any desired number of reinforcing rods may be provided.

In other embodiments, the design of the seat plate is not limited to the combination of the seat frame and the seat strut, and other design solutions can also be adopted. For example, the seat plate can be composed of multiple parts, and each part has different functions and characteristics to meet the different needs of users. These components can be adjustable to suit the user's body size and posture. For example, the seat board can be composed of a plurality of adjustable support parts, which can be adjusted according to the user's body size and posture to provide a more comfortable use experience. In addition, these components can be made of different materials and colors to meet the aesthetic needs of users. In the future, the sofa set will be continually optimized and improved to meet the changing needs of users and provide them with better products and services.

As shown in FIGS. 4 to 10, in this embodiment, the seat plate 3002 includes a front end 3008 and a rear end 3009, and a seat back plate 3010 is provided at the rear end 3009. The seat back plate 3010 includes a seat back frame 3011 and a plurality of seat back struts 3012, and the seat back struts 3012 are uniformly arranged in the seat back frame 3011. In other embodiments (not shown in the figure), the seat back plate can also be arranged in a plate-like structure.

Wherein, the seat back plate is an important part of the sofa set, which not only provides a comfortable backrest, but also adds a beautiful appearance to the sofa set. In other embodiments, the design of the seat back plate is not limited to the combination of the back frame and the back strut, and other design solutions can also be adopted. For example, the seat back plate can be composed of multiple parts, and each part has different functions and characteristics to meet the different needs of users. These components can be adjustable to suit the user's body size and posture. For example, the backrest plate can be composed of a plurality of adjustable support parts, which can be adjusted according to the user's body size and posture to provide a more comfortable use experience. In addition, these components can be made of different materials and colors to meet the aesthetic needs of users. In the future, the sofa set will be continually optimized and improved to meet the changing needs of users and provide them with better products and services.

Figure 4:
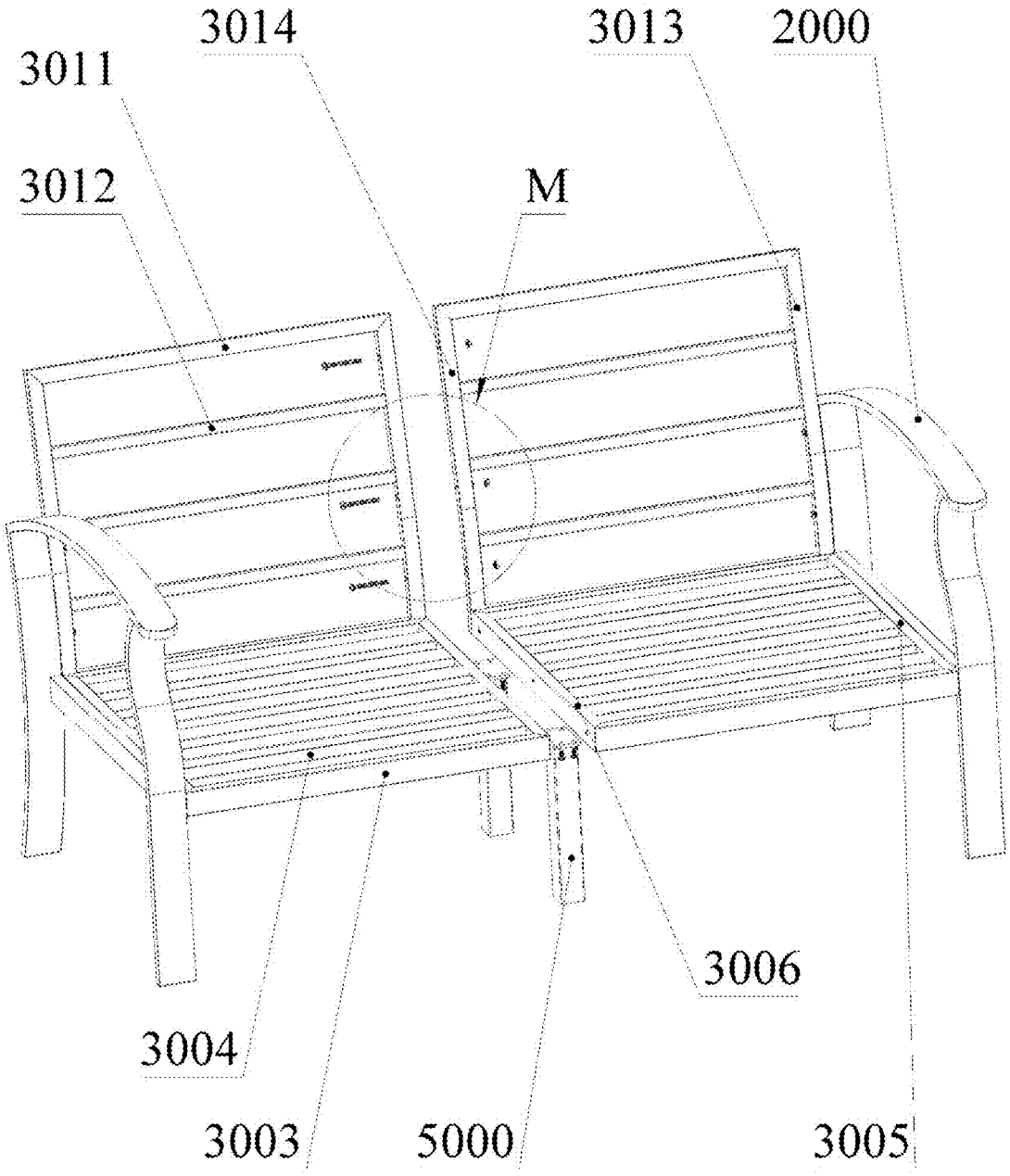
FIG. 4 is a partial exploded view of FIG. 3.
Figure 5:
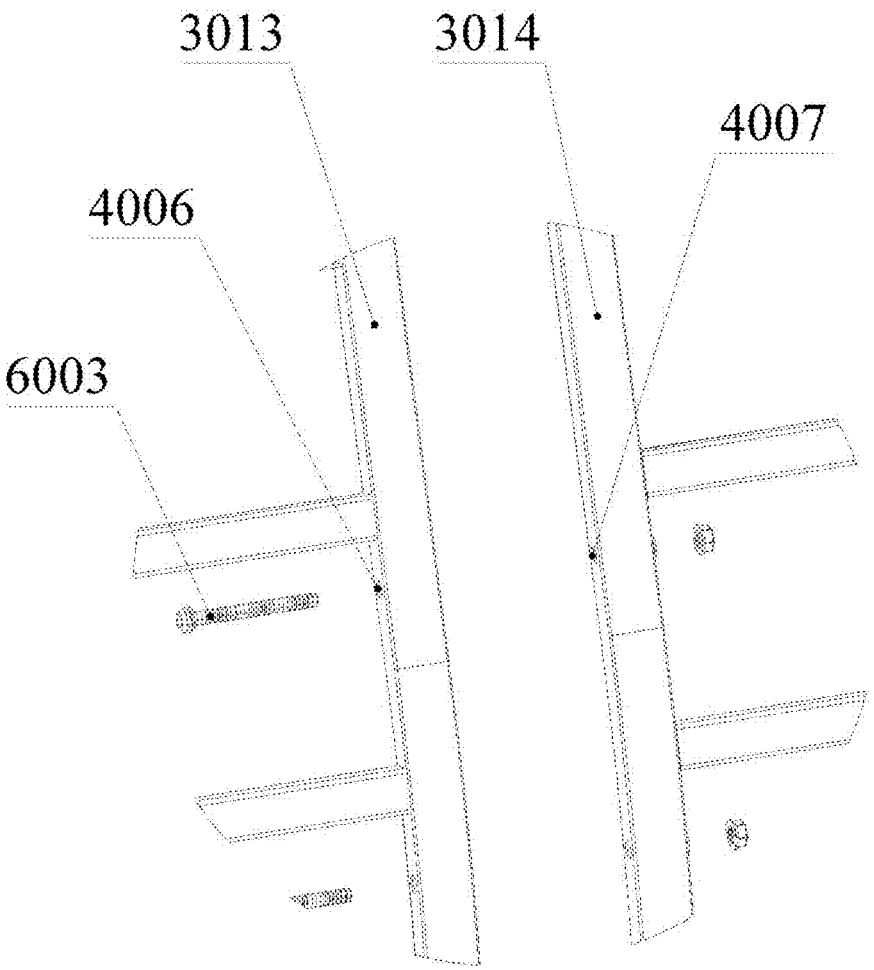
FIG. 5 is an enlarged schematic view at M in FIG. 4.
Figure 6:
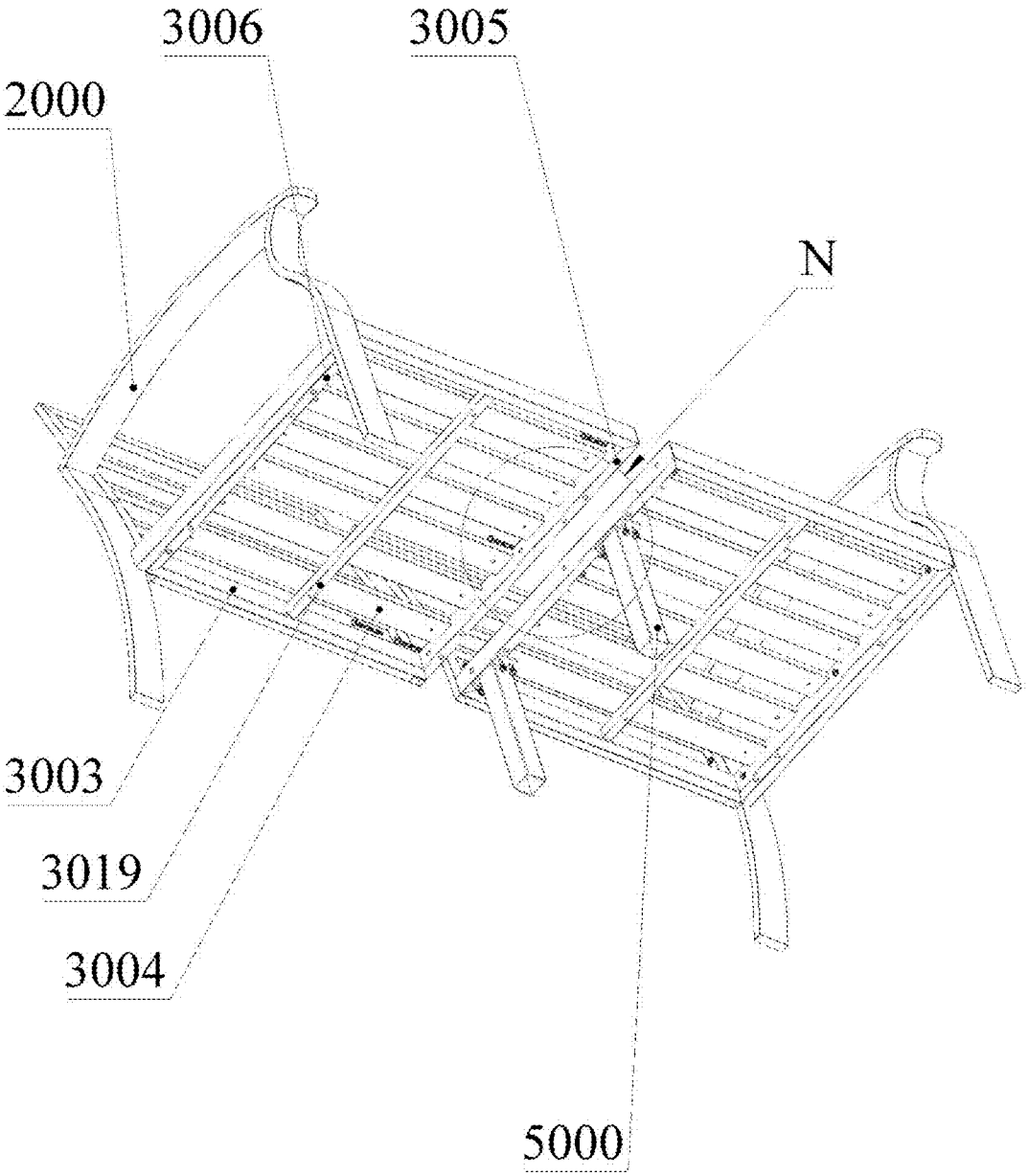
FIG. 6 is another schematic view of FIG. 4.
Figure 7:
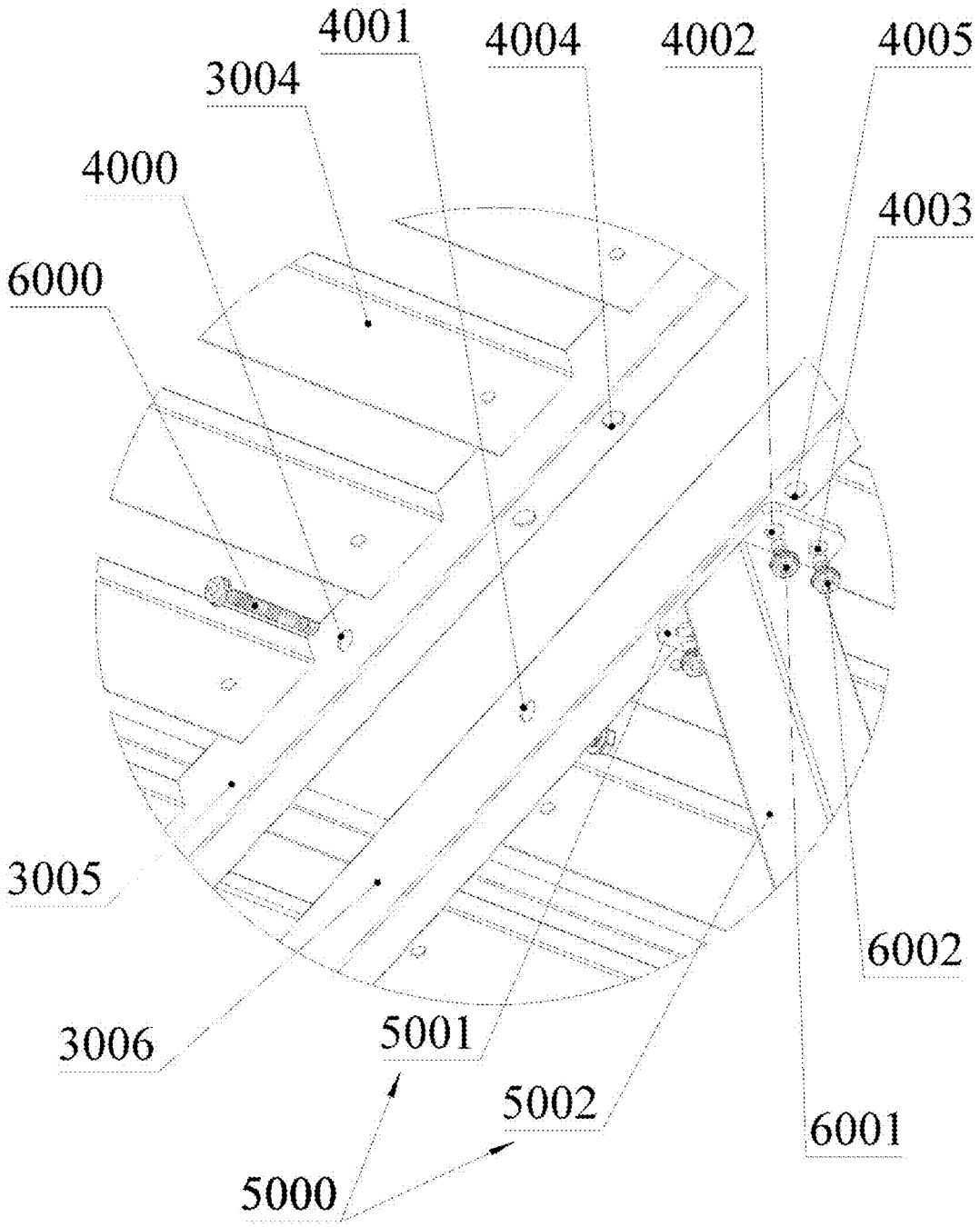
FIG. 7 is an enlarged schematic view at N in FIG. 6.
Figure 8:
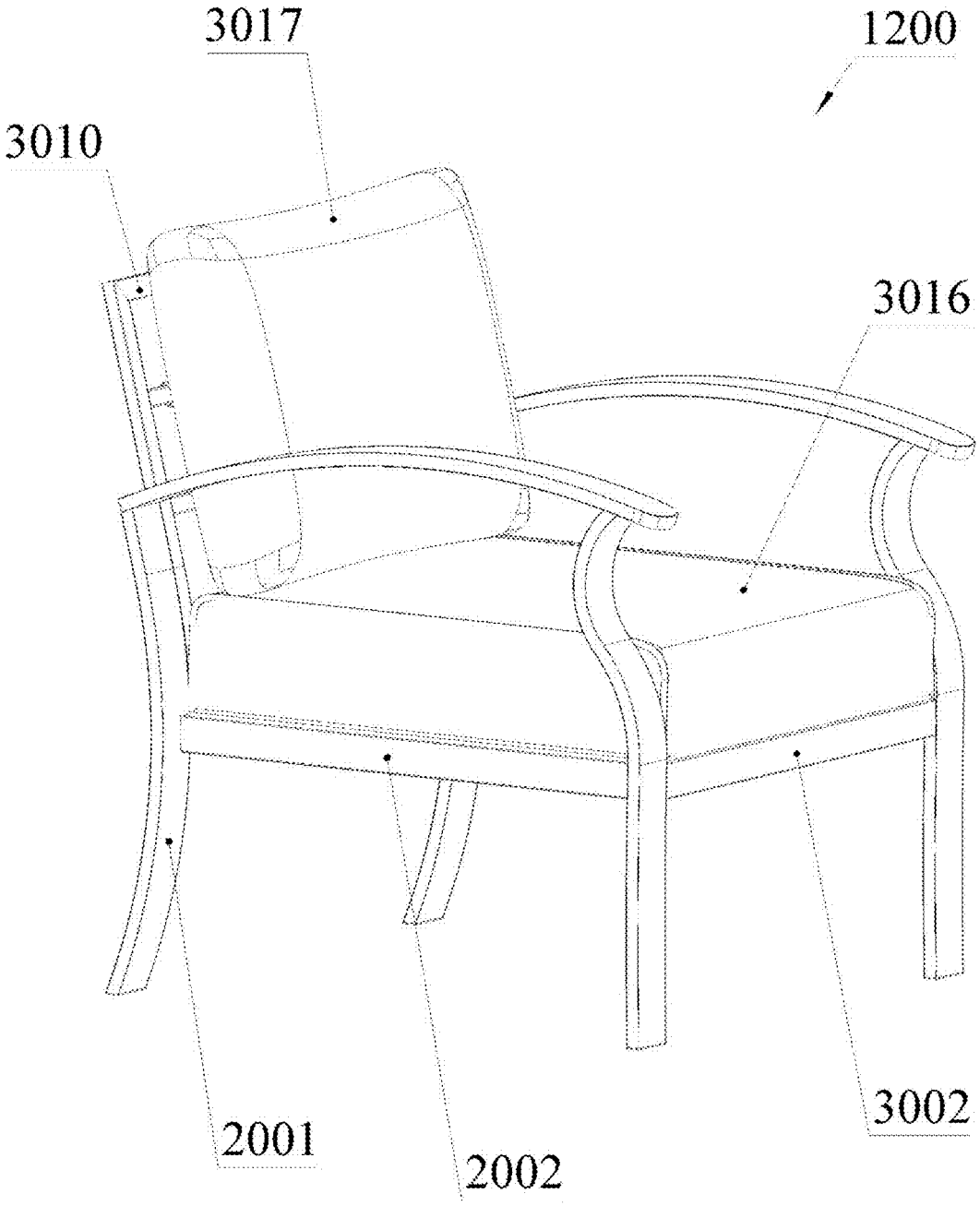
FIG. 8 is a schematic diagram of another embodiment 2 of the sofa set.

As shown in FIGS. 4 to 5, in this embodiment, the seat back frame 3011 includes a first seat back frame rod 3013 and a second seat back frame rod 3014, the first seat back frame rod 3013 is provided with at least one fixing hole G4006, and the second seat back frame rod 3014 is provided with at least one fixing hole H4007; and the fixing hole H4007 corresponds to the fixing hole G4006. When a plurality of seat back plates 3010 are assembled, the seat back plate 3010 and another seat back plate 3010 are fixed by the fourth fixing member 6003. This design can meet the user's demand for the stability and comfort of the seat back.

In other embodiments (not shown in the figure), the seat back plate and the other seat back plate are not limited to being fixedly connected by fixing members and fixing holes, and other connection modes can also be adopted. For example, the buckle connection can be adopted, which can make the seat back plate more firm and more convenient for disassembly and replacement. In addition, hook and loop connection can also be adopted, which can make the chair back board easier to disassemble and replace, and can also be adjusted as needed. In addition, other connection methods can be adopted, for example, the seat back plate and another seat back plate can be connected together by welding, which can make the back plate and the other back plate more firm and improve the overall aesthetics of the sofa set. In addition, the seat back plate and the other seat back plate can be connected together by adhesive connection, which can make the seat back plate and the other seat back plate more firm and improve the overall aesthetics of the sofa set. In addition, it can be set to any desired connection mode.

Figure 9:
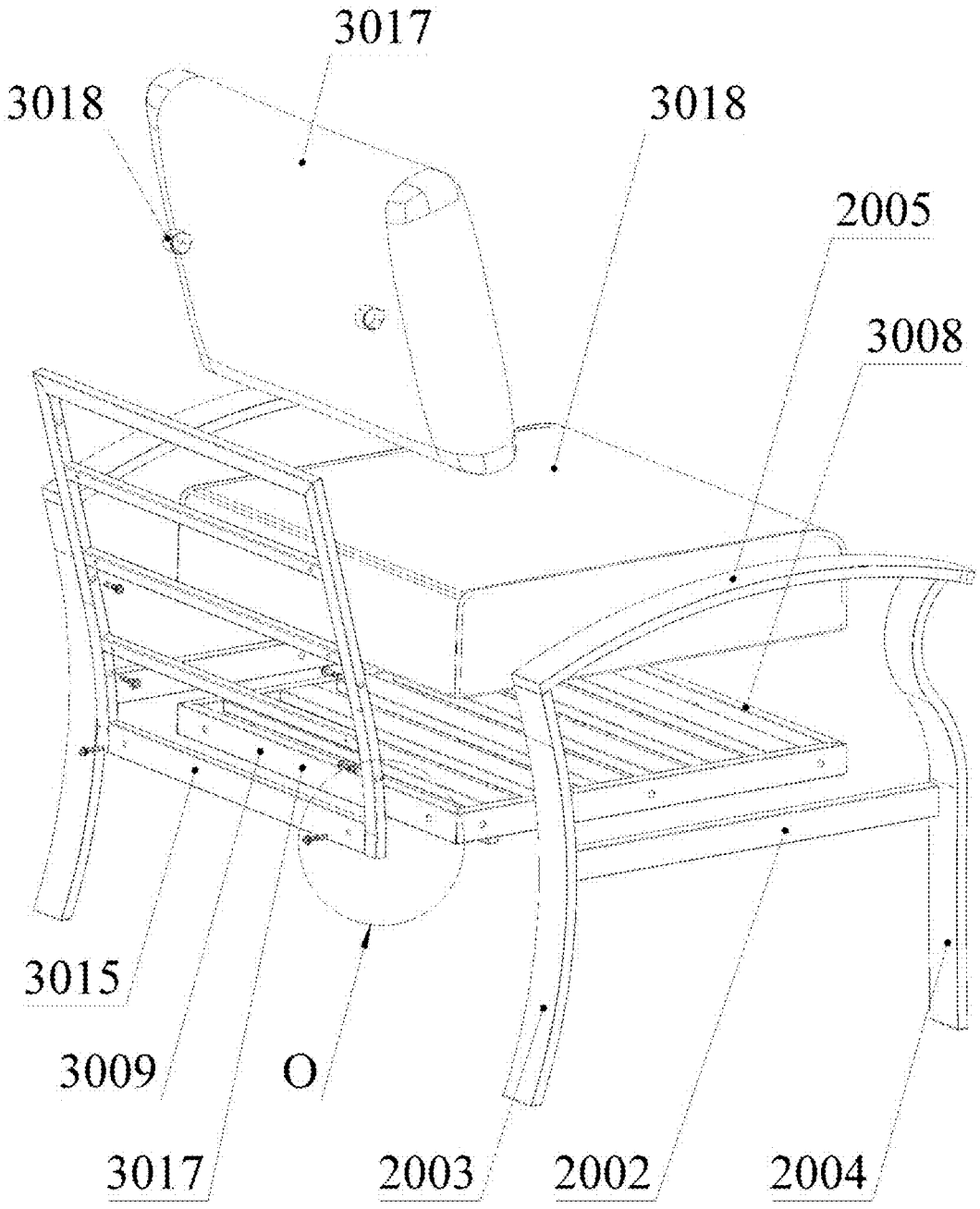
FIG. 9 is an explosion diagram of FIG. 8.
Figure 10:
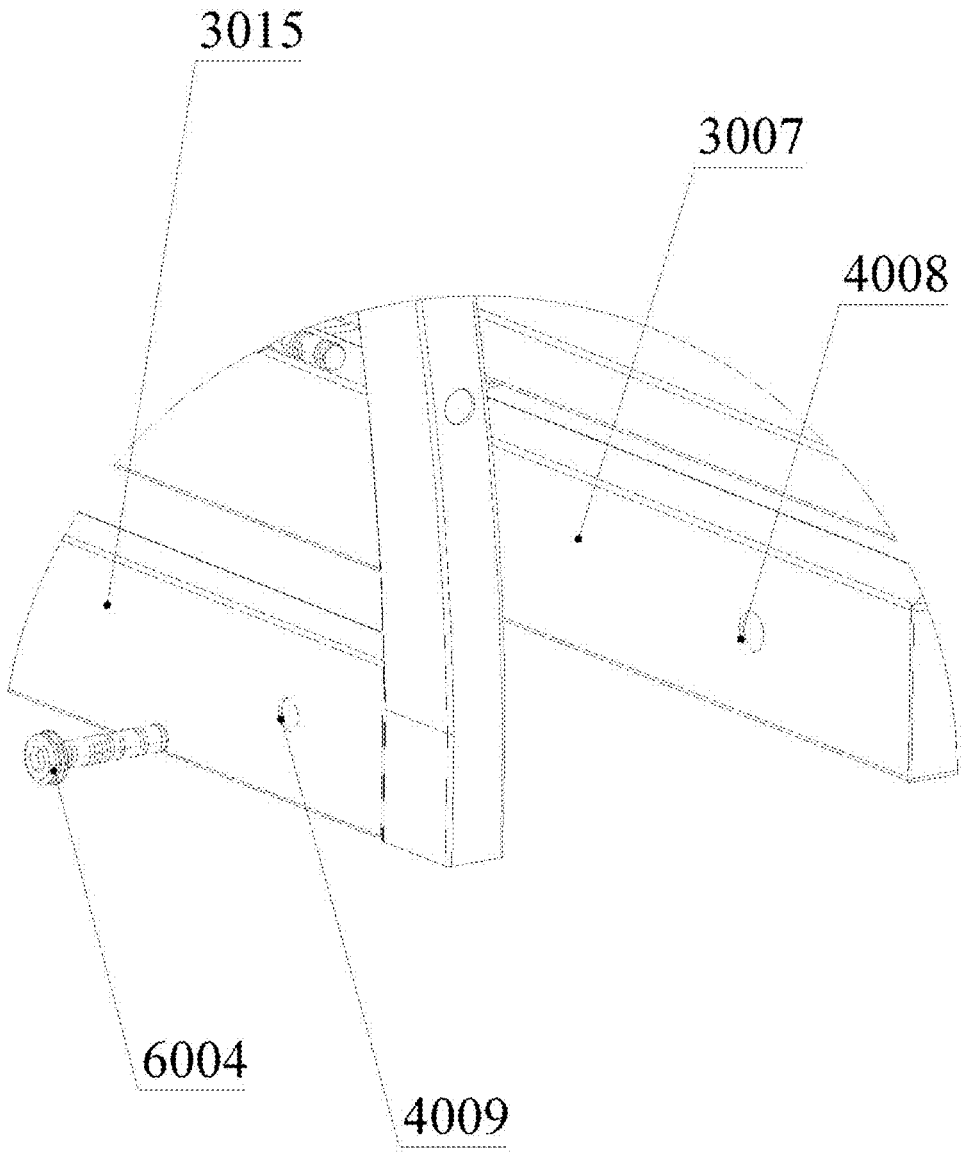
FIG. 10 is an enlarged schematic view at O in FIG. 9.

As shown in FIGS. 9 to 10, in this embodiment, the seat frame 3003 includes a third seat frame rod 3007, which is provided with at least one fixing hole I4008, and the seat back frame 3011 includes a third seat back frame rod 3015, which is provided with at least one fixing hole J4009 corresponding to the fixing hole I4008. Wherein, the seat plate 3002 and the seat back plate 3010 are fixedly connected by the fifth fixing member 6004. This design can make the seat unit and the seat back plate more firm, and it is also more convenient to disassemble and replace.

In other embodiments (not shown in the figure), the seat plate and the seat back plate are not limited to being fixedly connected by the fifth fixing member, and other connection modes can also be adopted. For example, a snap connection can be adopted, which can make the seat plate and the seat back plate firmer and more convenient for disassembly and replacement. In addition, hook and loop connection can be adopted, which can make the seat plate and the seat back plate easier to disassemble and replace, and can also be adjusted as needed. In addition, other connection methods can be used, for example, the seat plate and the seat back plate can be connected together by welding, which can make the seat plate and the seat back plate more firm and improve the overall aesthetics of the sofa set. In addition, the seat plate and the seat back plate can be connected together by adhesive connection, which can make the seat plate and the seat back plate more firm and improve the overall aesthetics of the sofa set. In addition, it can be set to any desired connection mode.

As shown in FIGS. 4 to 14, in this embodiment, the connecting foot stand 5000 includes a joint plate 5001 and a supporting foot 5002, and the joint plate 5001 is arranged above the supporting foot 5002, wherein the connecting foot stand 5000 has a substantially T-shaped cross section. The fixing hole C 4002 and the fixing hole D 4003 are arranged on the joint plate 5001. The connecting foot stand is an important part of sofa set, which not only provides stable support, but also adds beautiful appearance to sofa set.

In other embodiments (not shown in the figure), the connecting leg is not limited to having a substantially T-shaped cross section, but can also be set to be circular, square, triangular, elliptical and any desired geometric shape. These different geometric shapes can add different aesthetics and styles to the sofa set, and also meet the different aesthetic needs of users.

Figure 11:
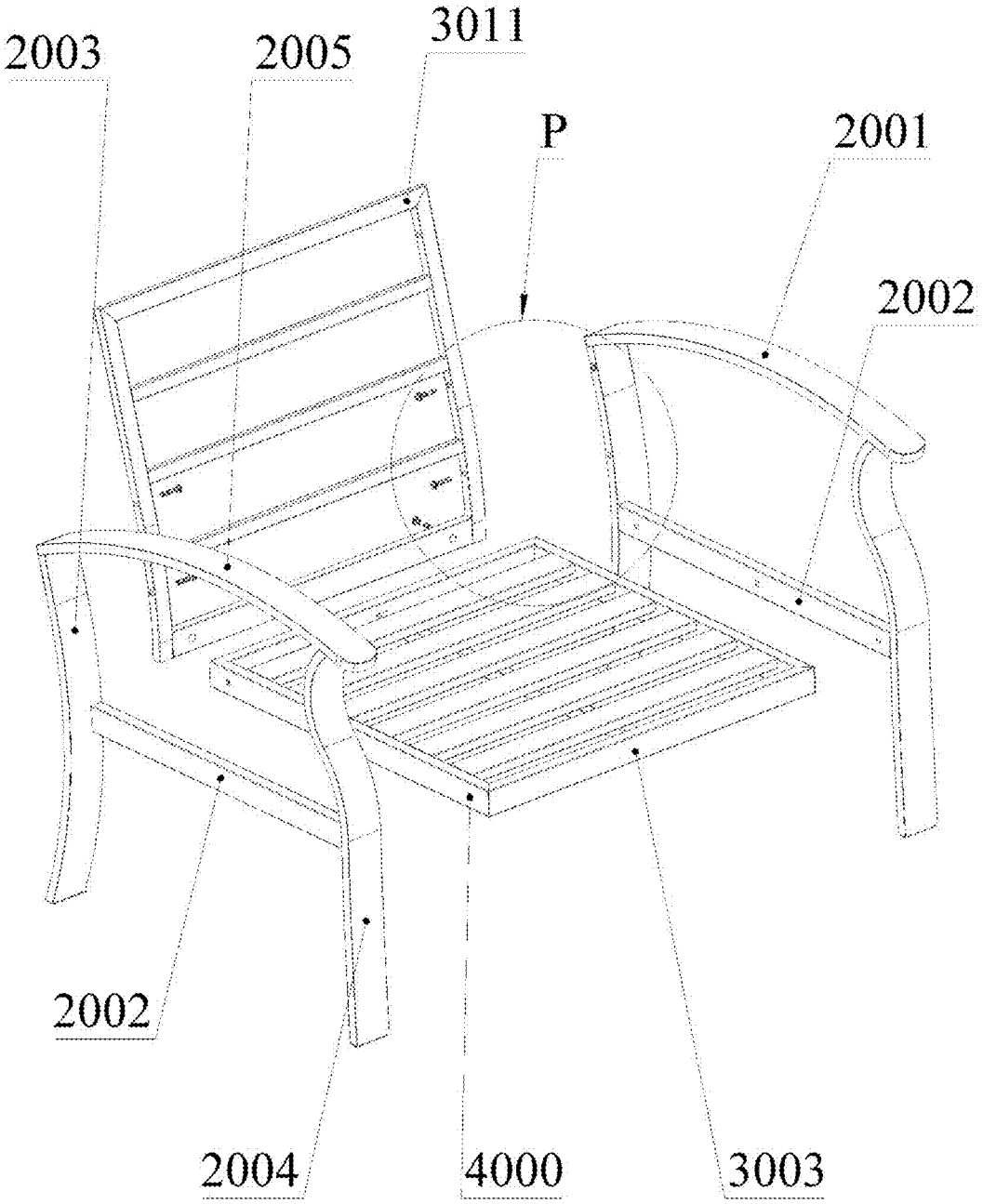
FIG. 11 is a partial schematic view of FIG. 9.
Figure 12:
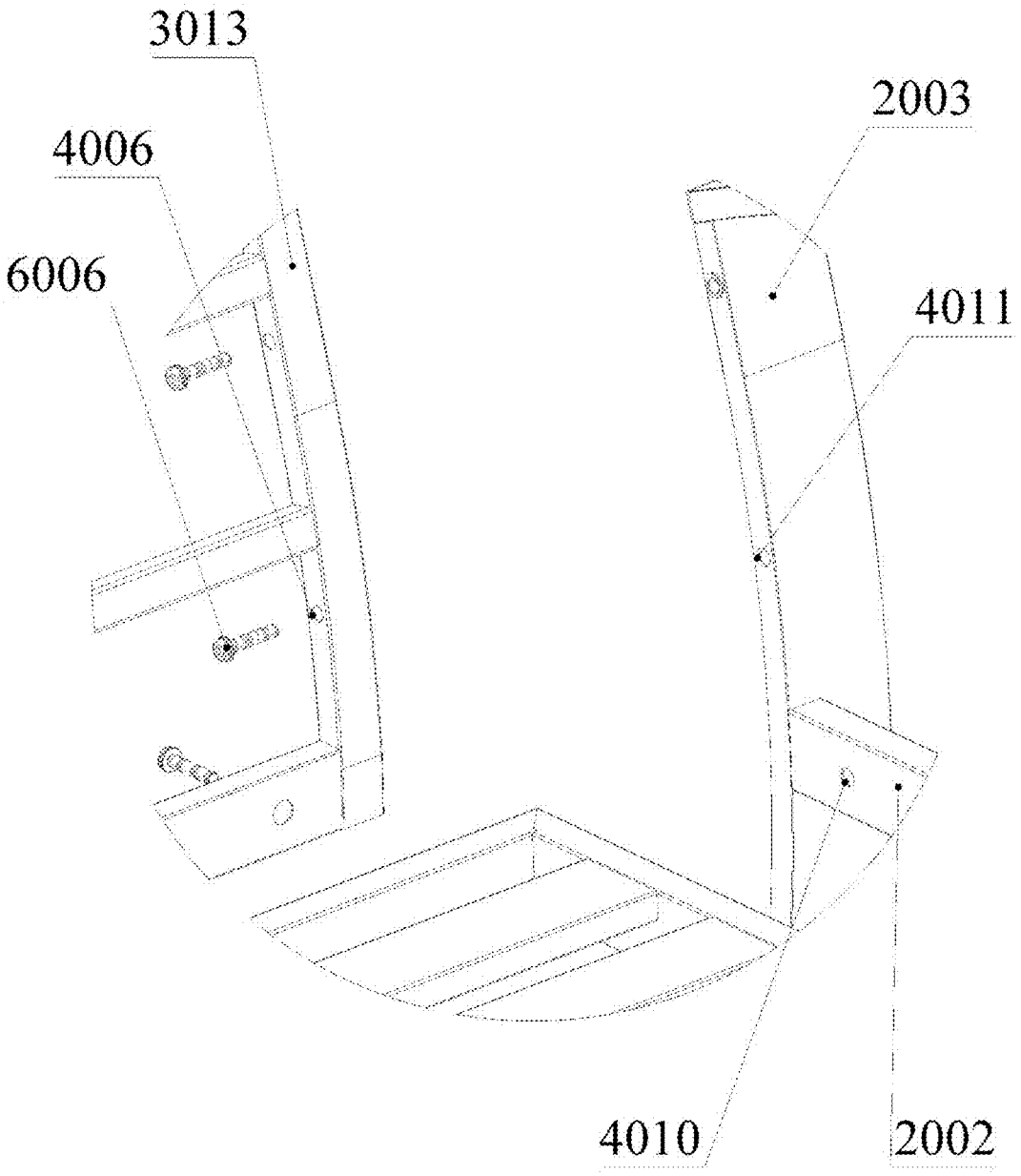
FIG. 12 is an enlarged schematic view at P in FIG. 11.
Figure 13:
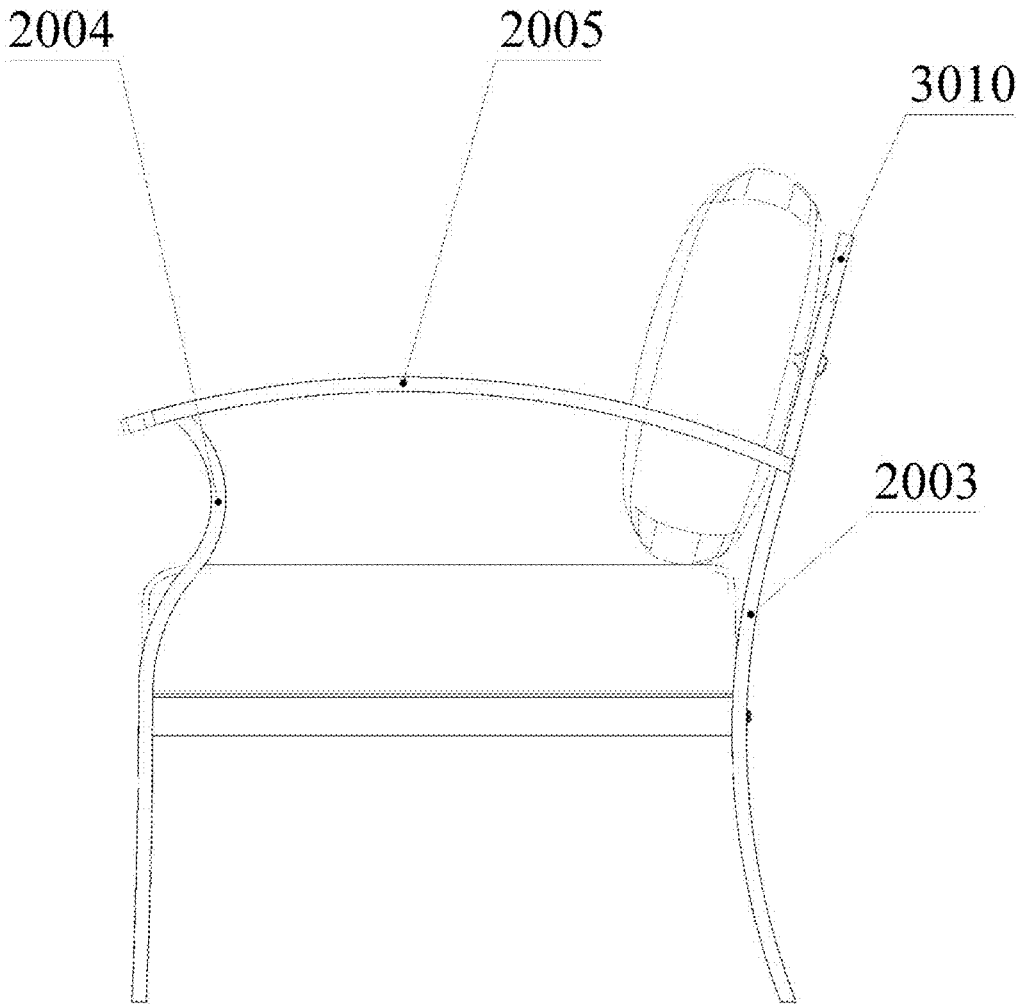
FIG. 13 is a side view of FIG. 8.
Figure 14:
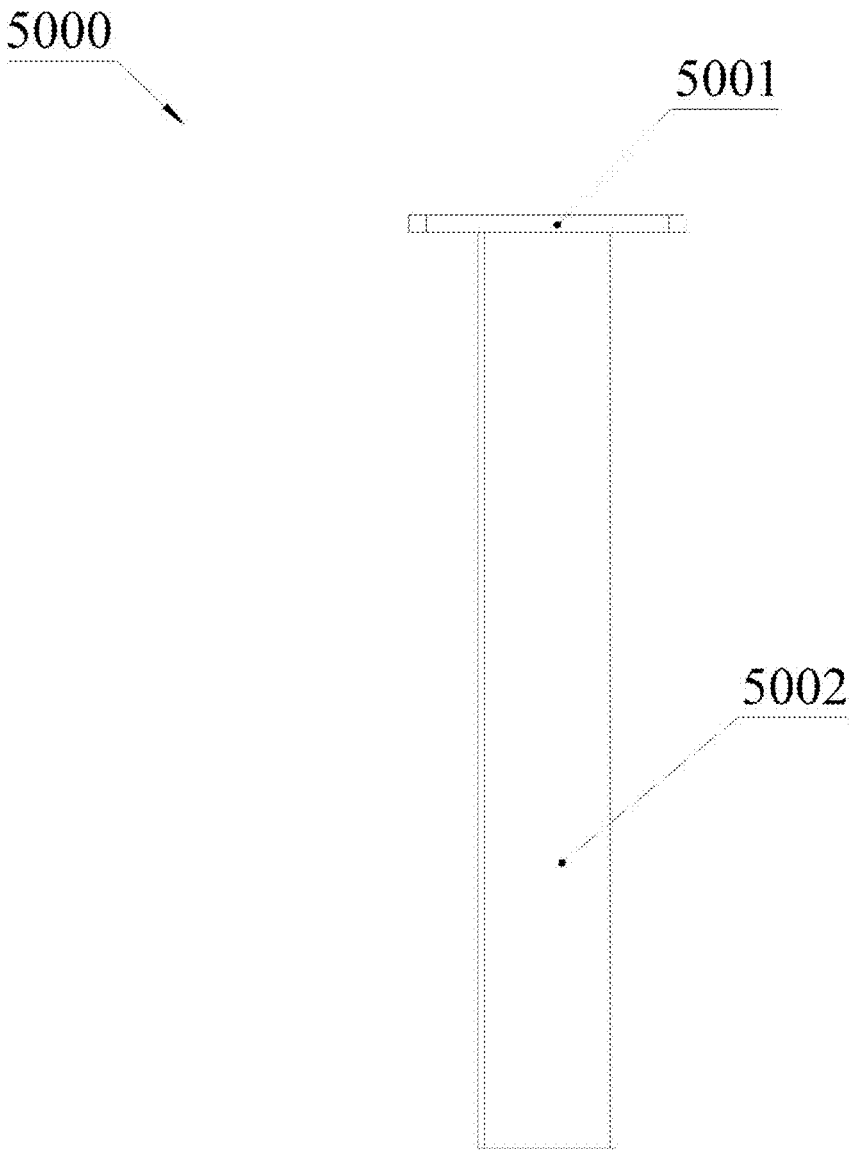
FIG. 14 is a schematic diagram of a connecting foot stand.

As shown in FIGS. 11 to 12, in this embodiment, the armrest framework 2000 includes an armrest frame 2001, in which at least one middle cross rod 2002 is provided, and at least one fixing hole K4010 is provided in the middle cross rod 2002. The fixing hole K4010 corresponds to the fixing hole A4000 and the fixing hole B 4001 (not shown in the figure). The seat plate 3002 is fixedly connected with the armrest framework 2000 by a sixth fixing member 6005. This design can make the armrest frame more firm, and it is also more convenient to disassemble and replace.

In other embodiments (not shown in the figure), the connection mode between the seat plate and the armrest framework is not limited to the fixed connection formed by the fixing members and the fixing holes, but also can be set as snap connection, welding, hook and loop connection, adhesive connection and any connection mode as desired. These different connection methods can be selected according to the design requirements of products and the characteristics of materials. For example, the snap connection can make the seat plate and armrest framework more firm, and it is also more convenient to disassemble and replace. Welding connection can make the seat plate and armrest framework closer, and at the same time, it can also improve the overall aesthetics of the sofa set. Hook and loop connection can make the seat plate and armrest framework easier to disassemble and replace, and can also be adjusted as needed. Adhesive connection can make the seat plate and armrest framework more firm, and at the same time, it can also improve the overall aesthetics of the sofa set. In addition, it can be set to any desired connection mode.

As shown in FIGS. 11 to 12, in this embodiment, the armrest frame 2001 includes a first support leg 2003 and a second support leg 2004, which are arranged at both ends of the middle cross rod 2002; the first support leg 2003 is close to one end of the seat back plate 3010, and the second support leg 2004 is far away from the seat back plate 3010. The first support leg 2003 is provided with at least one fixing hole L4011 corresponding to the fixing hole G4006 and the fixing hole H4007 (not shown in the figure). The seat back plate 3010 is fixedly connected with the armrest framework 2000 by a seventh fixing member 6006. This design can make the armrest frame more firm, and it is also more convenient to disassemble and replace.

In other embodiments (not shown in the figure), the connection mode between the seat back plate and the armrest framework is not limited to the fixed connection formed by the fixing members and the fixing holes, but also can be set as snap connection, welding, hook and loop connection, adhesive connection and any connection mode as desired. These different connection methods can be selected according to the design requirements of products and the characteristics of materials. For example, the snap connection can make the seat back plate and armrest framework more firm, and it is also more convenient to disassemble and replace. Welding connection can make the seat back plate and armrest framework closer, and at the same time, it can improve the overall aesthetics of the sofa set. Hook and loop connection can make the seat back plate and armrest framework easier to disassemble and replace, and can also be adjusted as needed. Adhesive connection can make the seat back plate and armrest framework more firm, and at the same time, it can also improve the overall aesthetics of the sofa set. In addition, it can be set to any desired connection mode.

As shown in FIGS. 1 to 9, in this embodiment, the seat cushion 3001 includes a cushion 3016 and a back cushion 3017, wherein the cushion 3016 is arranged on the seat plate 3002 and the back cushion 3017 is arranged on the seat cushion 3001, wherein the back cushion 3017 leans against the seat back plate 3010 and is detachably connected with the seat back plate 3010 through a strap 3018.

In other embodiments, the back cushion and the seat back plate are not limited to being fixedly connected by straps, but can also be arranged as hook and loop connection, snap connection, magnetic connection and any desired connection mode. In addition, the materials of the back cushion and the seat back plate may also be selected according to your needs, for example, soft cotton materials or hard plastic materials may be used. In terms of color, the colors of the back cushion and the seat back plate can match the color of the chair, or a color that contrasts with the color of the chair may be selected to enhance the visual effect. In addition, additional functions can be added, such as massage function, heating function or built-in audio, to improve the user's comfort and experience. Finally, the back cushion and the seat back plate can be made of environmentally friendly materials, such as recyclable materials or biodegradable materials, to reduce the impact on the environment.

As shown in FIGS. 1 to 13, in this embodiment, the seat back plate 3010 is provided with a certain radian, which is generally parabolic; In addition, the first support leg 2003 is provided with a curvature matching the curvature of the seat back plate 3010, which is also generally parabolic. In addition the materials of the back cushion and the seat back plate may also be selected according to your needs, for example, soft cotton materials or hard plastic materials may be selected. In terms of color, the colors of the back cushion and the seat back plate can match the color of the chair, or a color that contrasts with the color of the chair may be selected to enhance the visual effect. In addition, additional functions can be added, such as massage function, heating function or built-in audio, to improve the user's comfort and experience. Finally, the back cushion and the seat back plate can be made of environmentally friendly materials, such as recyclable materials or biodegradable materials, to reduce the impact on the environment.

In other embodiments (not shown in the figure), the seat back plate and the first support leg are not limited to being parabolic, but can also be semicircular, elliptical, square, circular and any desired geometric shapes.

As shown in FIGS. 1 to 13, in this embodiment, the armrest frame 2001 further includes an armrest rod 2005, which is arranged on the first support leg 2003 and the second support leg 2004, and the armrest rod 2005 is arranged in a substantially parabolic shape, and the second support leg 2004 is arranged in a crutch shape.

In other embodiments (not shown in the figure), the handrail is not limited to a roughly parabolic shape, and the second support leg is not limited to a crutch shape, but can also be set to a semicircle, an ellipse, a square, a circle and any desired geometric shape. The choice of these shapes should be based on many factors, such as usage scene, ergonomics, aesthetics and materials.

Figure 15:
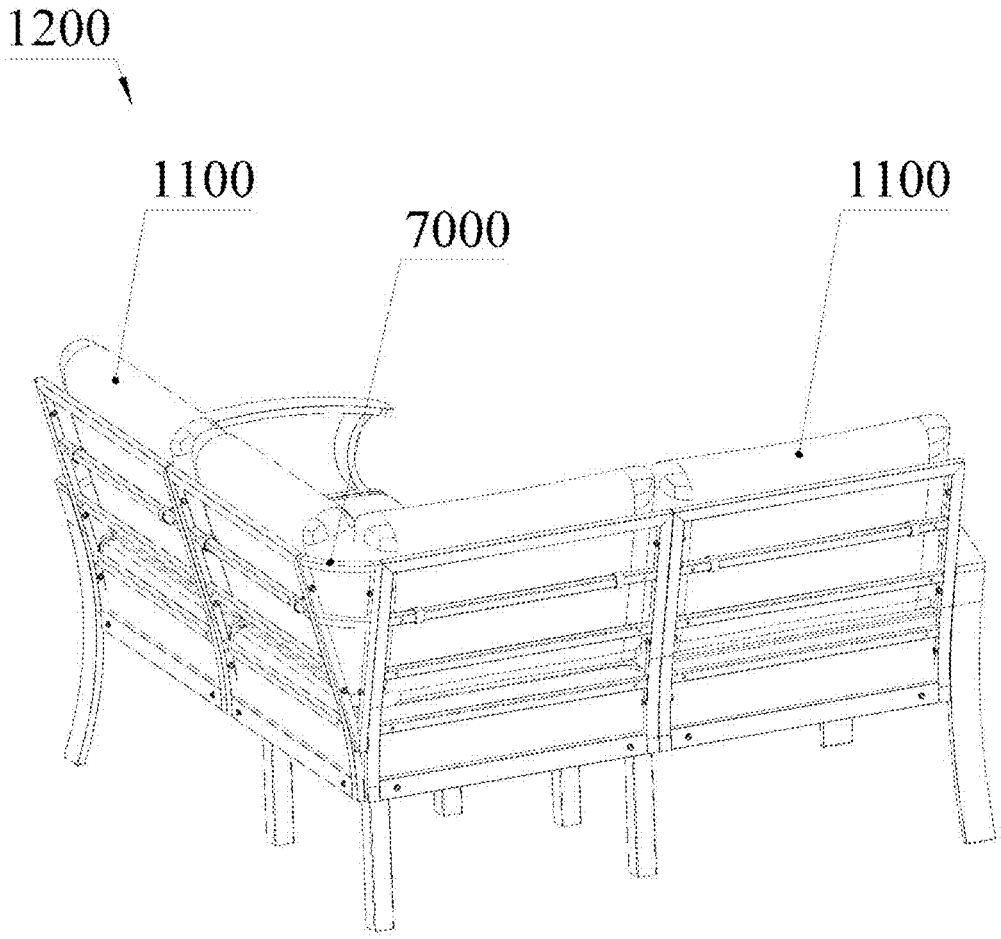
FIG. 15 is a schematic diagram of another embodiment 3 of the sofa set.
Figure 16:
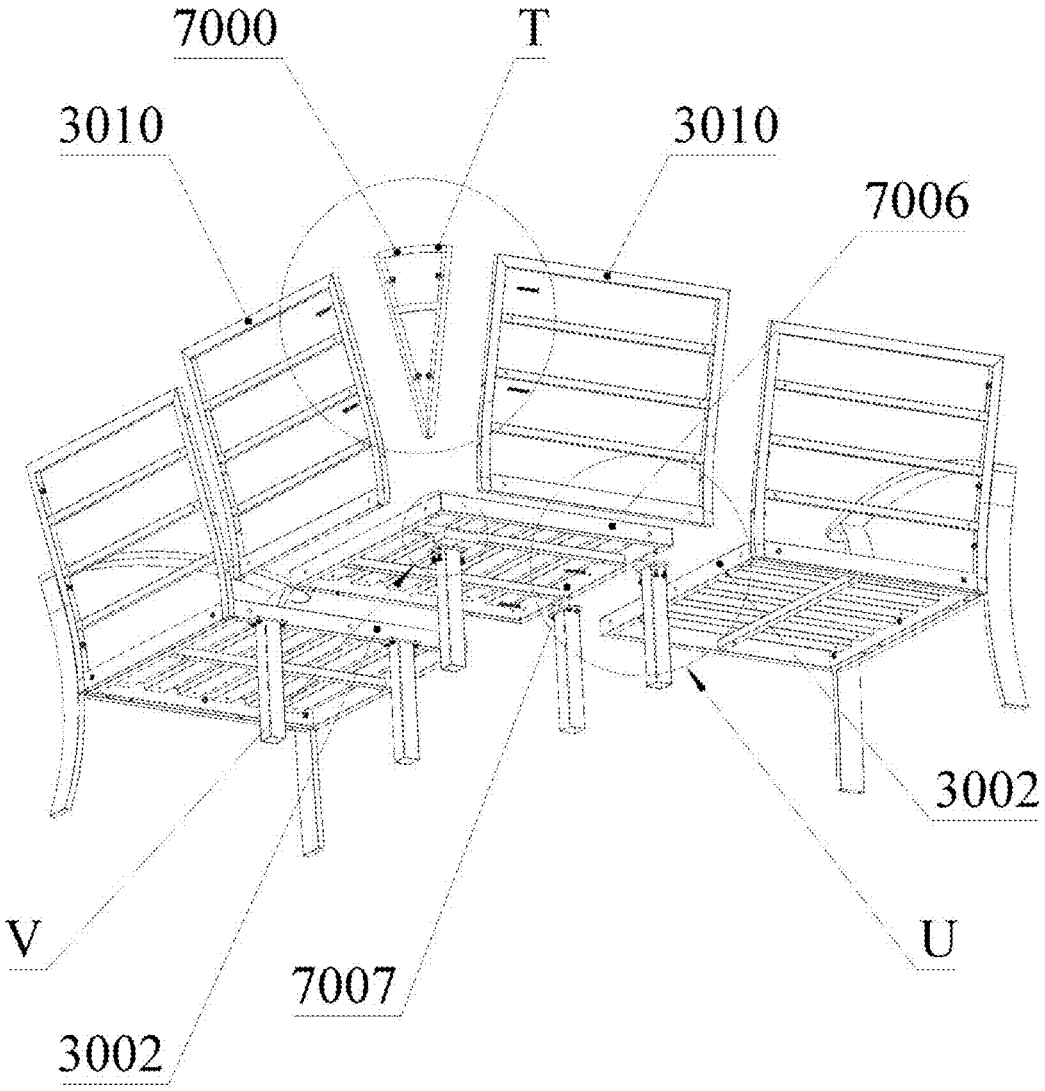
FIG. 16 is a partial exploded view of FIG. 15.
Figure 17:
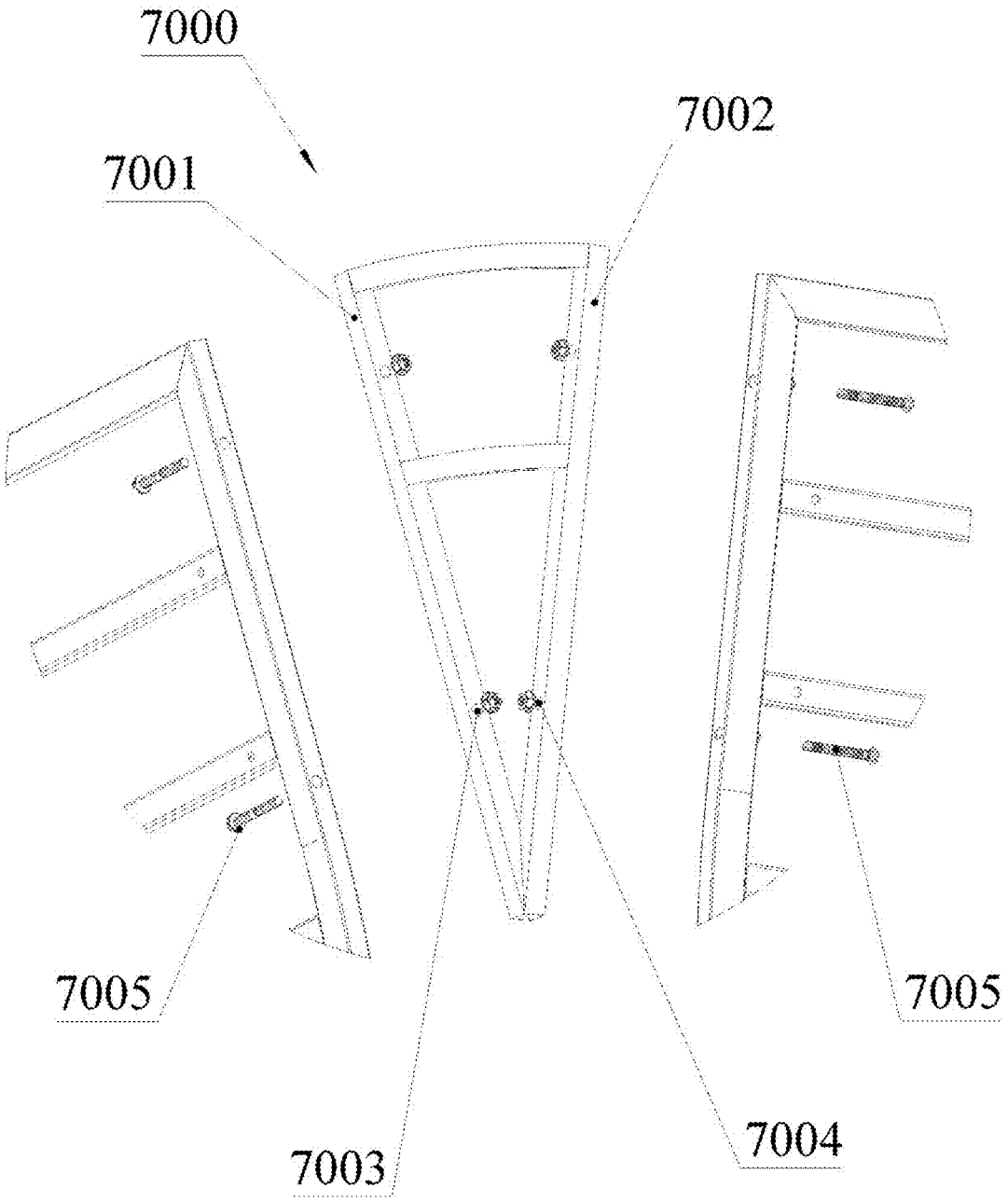
FIG. 17 is an enlarged schematic view at T in FIG. 16.
Figure 18:
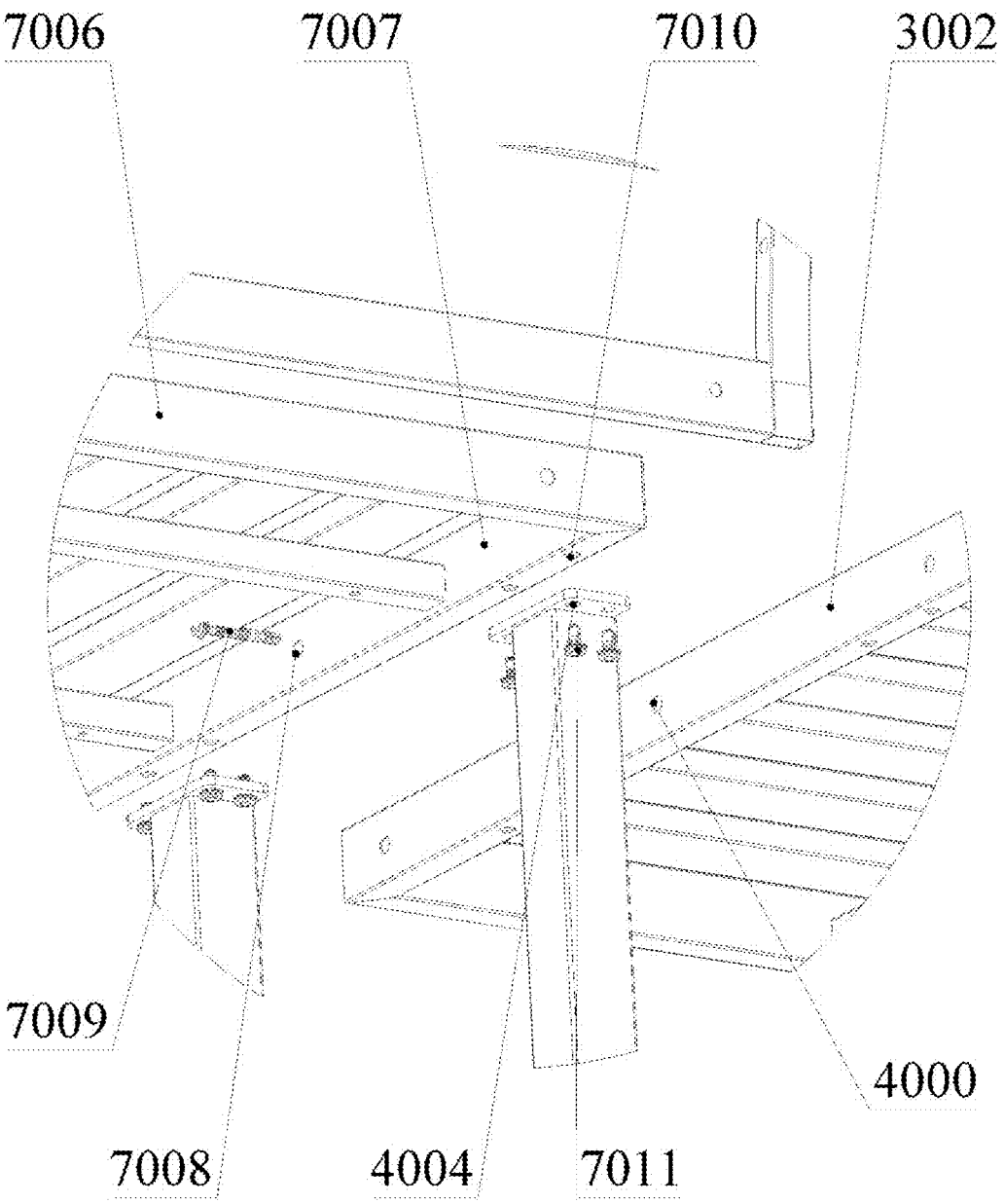
FIG. 18 is an enlarged schematic view at V in FIG. 16.
Figure 19:
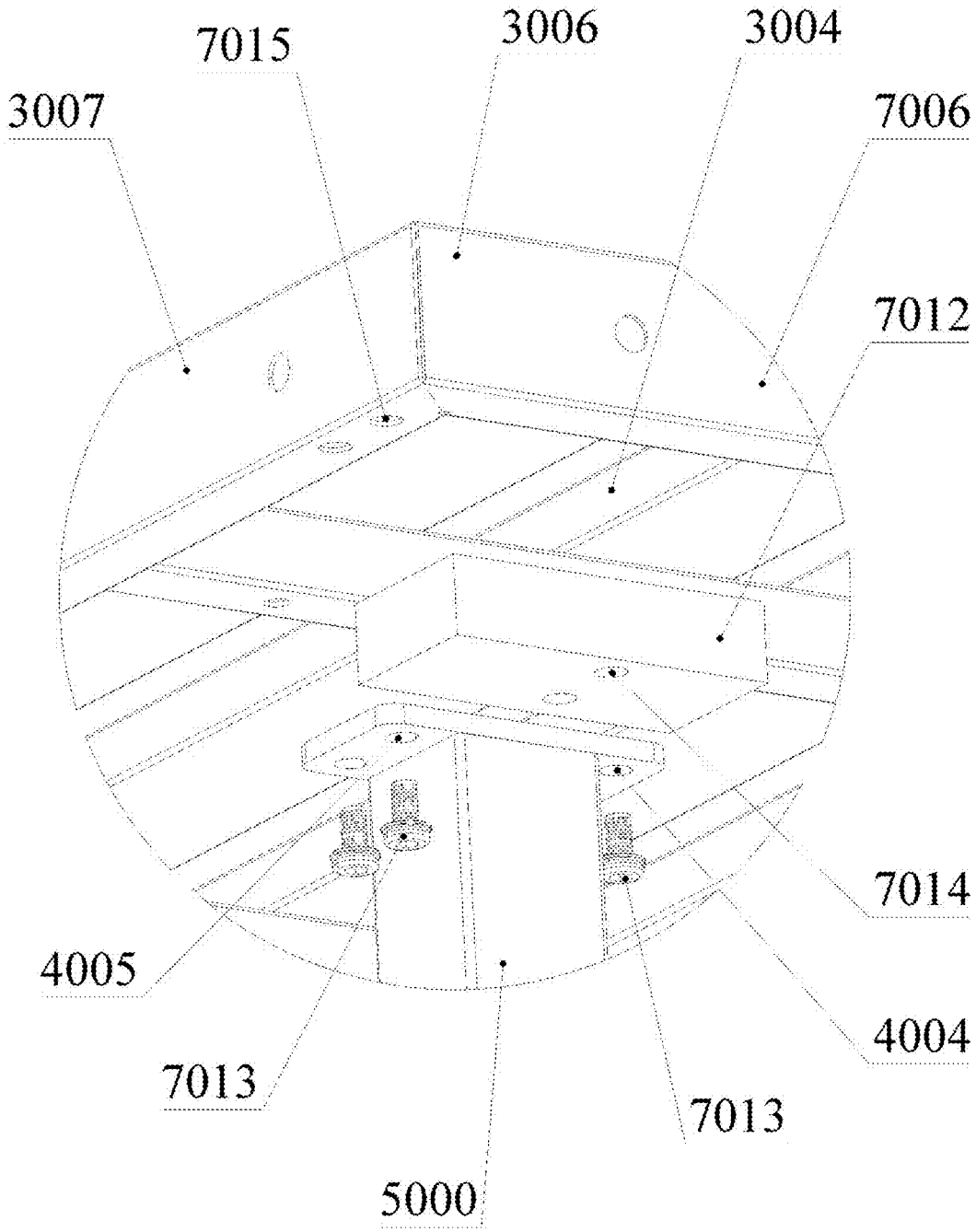
FIG. 19 is an enlarged schematic view at U in FIG. 16.

As shown in FIGS. 15 to 17, in this embodiment, the sofa set 1200 includes a corner joint frame 7000, and the corner joint frame 7000 includes a first joint rod 7001 and a second joint rod 7002.

Wherein, the first joint rod 7001 is provided with at least one fixing hole Q 7003, which corresponds to the fixing hole G4006 and the fixing hole H4007, and the second joint rod 7002 is provided with at least one fixing hole R 7004, which corresponds to the fixing hole G4006 and the fixing hole H4007. The corner joint frame 7000 is connected with the seat back frame 3011 through the eighth fixing member 7005.

In this embodiment, the seat plate 3002 includes a corner joint plate 7006, and the fixing holes A4000 and B 4001 in the corner joint plate 7006 correspond to the fixing holes J4009.

As shown in FIGS. 15 to 18, in this embodiment, the corner joint plate 7006 includes a fourth seat frame rod 7007, which is provided with at least one fixing hole S 7008 corresponding to the fixing hole A 4000 and the fixing hole B (not shown in the figure), and the fourth seat frame rod 7007 is fixedly connected with the seat plate 3002 through a ninth fixing member 7009.

In this embodiment, the fourth seat frame rod 7007 is also provided with at least one fixing hole W7010 corresponding to the fixing hole E 4004 and the fixing hole F (not shown in the figure), and the fourth seat frame rod 7007 is fixedly connected with the connecting foot stand 5000 through the tenth fixing member 7011.

As shown in FIGS. 15 to 19, in this embodiment, a joint block 7012 is further included, and the joint block 7012 is arranged at the included angle between the third seat frame rod 3007 and the second seat frame rod 3006 of the corner joint plate 7006, and between the seat strut 3004 and the connecting foot stand 5000. The joint block 7012 is provided with a fixing hole X7014 corresponding to the fixing hole E 4004 and the fixing hole F 4005, and the third seat frame rod 3007 is provided with a fixing hole Y7015 corresponding to the fixing hole E 4004 and the fixing hole F 4005, wherein the joint block 7012, the third seat frame rod 3007 and the connecting foot stand 5000 are fixedly connected by a eleventh fixing member 7013.

In this embodiment, two seat plates 3002 and two seat back plates 3010, namely two seat units 1100, are connected to the corner joint plate 7006. Wherein, a corner joint frame 7000 is arranged between two seat back plates 3010, thus forming a corner structure of the sofa set 1200. In other embodiments, the sofa set is not limited to forming a corner connection by the corner joint plate 7006 and the corner joint frame 7000, but can also be set to any desired connection structure. The present invention also provides a method for assembling the sofa set, which includes the following steps: providing a sofa set convenient to assemble; and wherein, the sofa set includes a seat assembly and at least one armrest framework, wherein the armrest framework is detachably attached at both ends of the seat assembly; and the seat assembly includes at least one seat unit, wherein the seat unit includes a seat frame and a seat cushion, and the seat cushion is configured on the seat frame; and wherein, the seat frame includes a seat plate, and the seat plate includes a first seat frame rod and a second seat frame rod, wherein the first seat frame rod is provided with at least one fixing hole A, and at least one fixing hole B is arranged on the second seat frame rod, and the fixing hole A corresponds to the fixing hole B; and wherein, the sofa set further includes a connecting foot stand, wherein the connecting foot stand is provided with at least one fixing hole C and at least one fixing hole D; the first seat frame rod is provided with at least one fixing hole E, and the fixing holes E corresponds to the fixing hole C; and the second seat frame is provided with at least one fixing hole F, and the fixing hole F corresponds to the fixing hole D; and the method includes the following steps:

placing the seat units to be assembled in a same direction, and fixedly connecting the seat units with another seat unit through a first fixing member;

configuring the connecting foot stand at a corresponding position of the seat assembly, and then fixedly connecting the connecting foot stand with the seat assembly through a second fixing member and a third fixing member; and attaching the armrest framework to both ends of the seat assembly.

Wherein, the seat frame includes a third seat frame rod, at least one fixing hole I is arranged on the third seat frame rod, and the seat back frame includes a third seat back frame rod, and at least one fixing hole J is arranged on the third seat back frame rod, and the fixing hole J corresponds to the fixing hole I; and wherein, when the seat units are assembled, the seat plate and the seat back plate are fixedly connected through a fifth fixing member.

The technical means disclosed in the solution of the present invention are not limited to the technical means disclosed in the above embodiments, but also include the technical solution composed of any combination of the above technical features. It should be pointed out that for those skilled in the art, several improvements and embellishments can be made without departing from the principle of the present invention, and these improvements and embellishments are also regarded as the protection scope of the present invention.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. An assembly structure of a sofa set, comprising:

a plurality of seat plates; and wherein said seat plate comprises a first seat frame rod and a second seat frame rod, wherein said first seat frame rod is provided with at least one fixing hole A, and said second seat frame rod is provided with at least one fixing hole B; and at least one connecting foot stand; and wherein said connecting foot stand is provided with a joint plate, at least one fixing hole C and at least one fixing hole D are provided on said joint plate; and said first seat frame rod is provided with at least one fixing hole E, and said fixing hole E corresponds to said fixing hole C; said second seat frame rod is provided with at least one fixing hole F, and said fixing hole F corresponds to said fixing hole D; and wherein, when a plurality of seat plates are assembled, said seat plate and said other seat plate are fixed by a first fixing member, said seat plate and said connecting foot stand are fixed by a second fixing member, and said other seat plate and said connecting foot stand are fixed by a third fixing member.

2. The assembly structure of a sofa set according to claim 1, wherein said seat plate comprises a seat frame, and a plurality of seat struts are uniformly arranged in said seat frame, wherein at least one reinforcing rod is further arranged below said seat struts.

3. The assembly structure of a sofa set according to claim 2, wherein said seat plate comprises a front end and a rear end, and a seat back plate is arranged at said rear end, and said seat back plate comprises a back frame and a plurality of seat back struts; and said seat back struts are uniformly arranged in said seat back frame.

4. The assembly structure of a sofa set according to claim 3, wherein said seat back frame comprises a first seat back frame rod and a second seat back frame rod; and said first seat back frame rod is provided with at least one fixing hole G, and at least one fixing hole H is arranged on said second seat back frame rod, and said fixing hole H corresponds to said fixing hole G; and wherein, when a plurality of said seat back plates are assembled, said seat back plates and another seat back plate are fixed by a fourth fixing member.

5. The assembly structure of a sofa set according to claim 4, wherein said seat frame comprises a third seat frame rod, and at least one fixing hole I is arranged on said third seat frame rod; said seat back frame comprises a third seat back frame rod, at least one fixing hole J is arranged on said third seat back frame rod, and said fixing hole J corresponds to said fixing hole I; and wherein, said seat plate and said seat back plate are fixedly connected by a fifth fixing member.

6. A sofa set convenient to assemble, said sofa set comprising:

a seat assembly and at least one armrest framework, wherein said armrest framework is detachably attached at both ends of said seat assembly; and said seat assembly comprises at least one seat unit, wherein said seat unit comprises a seat frame and a seat cushion, and said seat cushion is configured on said seat frame; and wherein, said seat frame comprises a seat plate, and said seat plate comprises a first seat frame rod and a second seat frame rod, wherein said first seat frame rod is provided with at least one fixing hole A, and at least one fixing hole B is arranged on said second seat frame rod, and said fixing hole A corresponds to the fixing hole B; and wherein, the sofa set further comprises a connecting foot stand, wherein said connecting foot stand is provided with at least one fixing hole C and at least one fixing hole D; and said first seat frame rod is provided with at least one fixing hole E, and said fixing holes E corresponds to said fixing hole C; and said second seat frame rod is provided with at least one fixing hole F, and said fixing hole F corresponds to said fixing hole D; and wherein, when a plurality of seat units are assembled, said seat unit and another seat unit are fixed by a first fixing member, said seat unit and said connecting foot stand are fixed by a second fixing member, and said other seat unit and said connecting foot stand are fixed by a third fixing member.

7. The assembly structure of a sofa set according to claim 6, wherein said seat plate comprises a seat frame, and a plurality of seat struts are uniformly arranged in said seat frame, wherein at least one reinforcing rod is further arranged below said seat struts.

8. The assembly structure of said sofa set according to claim 7, wherein said seat plate comprises a front end and a rear end, and a seat back plate is arranged at said rear end, and said seat back plate comprises a back frame and a plurality of seat back struts; and said seat back struts are uniformly arranged in said seat back frame.

9. The assembly structure of a sofa set according to claim 8, wherein said seat back frame comprises a first seat back frame rod and a second seat back frame rod; said first seat back frame rod is provided with at least one fixing hole G, and at least one fixing hole H is arranged on said second seat back frame rod, and said fixing hole H corresponds to said fixing hole G; and wherein, when a plurality of said seat back plates are assembled, said seat back plates and another seat back plate are fixed by a fourth fixing member.

10. The assembly structure of said sofa set according to claim 9, wherein said seat frame comprises a third seat frame rod, and at least one fixing hole I is arranged on said third seat frame rod; said seat back frame comprises a third seat back frame rod, at least one fixing hole J is arranged on said third seat back frame rod, and said fixing hole J corresponds to said fixing hole I; and wherein, said seat plate and said seat back plate are fixedly connected by a fifth fixing member.

11. The assembly structure of a sofa set according to claim 10, wherein said connecting foot stand comprises a joint plate and a supporting foot, and said joint plate is arranged above said supporting foot, wherein said connecting foot stand has a substantially T-shape.

12. The assembly structure of a sofa set according to claim 11, wherein said armrest framework comprises an armrest frame, in which at least one middle cross rod is arranged; at least one fixing hole K is arranged on said middle cross rod, and said fixing hole K corresponds to said fixing hole A and said fixing hole B; and wherein, said seat plate is fixedly connected with said armrest framework through a sixth fixing member.

13. The assembly structure of a sofa set according to claim 12, wherein said armrest frame comprises a first support leg and a second support leg, and said first support leg and said second support leg are arranged at both ends of said middle cross rod; said first support leg is at an end close to said seat back plate, and said second support leg is at an end far away from said seat back plate; and said first support leg is provided with at least one fixing hole L corresponding to said fixing hole G and said fixing hole H; and wherein, said seat back plate is fixedly connected with said armrest framework through a seventh fixing member.

14. The assembly structure of a sofa set according to claim 13, wherein said seat cushion comprises a cushion and a back cushion, wherein said cushion is arranged on said seat plate and said back cushion is arranged on said seat cushion, wherein, said back cushion leans against the seat back plate and is detachably connected with said seat back plate through a strap.

15. The assembly structure of said sofa set according to claim 14, wherein said seat back plate is provided with a certain radian and is generally parabolic; and wherein, said first support leg is provided with a radian matching said seat back plate, and is generally parabolic.

16. The assembly structure of a sofa set according to claim 15, wherein said armrest frame further comprises an armrest rod arranged on said first support leg and said second support leg, and said armrest rod is configured to be generally parabolic.

17. The assembly structure of a sofa set according to claim 16, wherein said sofa set comprises a corner joint frame, and said corner joint frame comprises a first joint rod and a second joint rod; and wherein, said first joint rod is provided with at least one fixing hole Q, which corresponds to said fixing hole G and said fixing hole H; and at least one fixing hole R is arranged on said second joint rod, and said fixing hole R corresponds to said fixing hole G and said fixing hole H; and said corner joint frame is connected with said seat back frame through an eighth fixing member.

18. The assembly structure of a sofa set according to claim 17, wherein said seat plate comprises a corner joint plate, and said fixing hole A and said fixing hole B in said corner joint plate correspond to said fixing hole J; and wherein, said corner joint plate comprises a fourth seat frame rod, and at least one fixing hole S is arranged on said fourth seat frame rod, and said fixing hole S corresponds to said fixing hole A and said fixing hole B; and said fourth seat frame rod is fixedly connected with said seat plate through a ninth fixing member.

19. A method for assembling a sofa set, comprising: providing a sofa set convenient to assemble;

wherein, said sofa set comprises a seat assembly and at least one armrest framework, wherein said armrest framework is detachably attached at both ends of said seat assembly; and said seat assembly comprises at least one seat unit, wherein said seat unit comprises a seat frame and a seat cushion, and said seat cushion is configured on said seat frame; and wherein, said seat frame comprises a seat plate, and said seat plate comprises a first seat frame rod and a second seat frame rod, wherein said first seat frame rod is provided with at least one fixing hole A, and at least one fixing hole B is arranged on said second seat frame rod, and said fixing hole A corresponds to the fixing hole B; and wherein, the sofa set further comprises a connecting foot stand, wherein said connecting foot stand is provided with at least one fixing hole C and at least one fixing hole D; said first seat frame rod is provided with at least one fixing hole E, and said fixing holes E corresponds to said fixing hole C; and said second seat frame rod is provided with at least one fixing hole F, and said fixing hole F corresponds to said fixing hole D; and the method comprises the following steps:

placing the seat units to be assembled in a same direction, and fixedly connecting said seat units with another seat unit through a first fixing member;

configuring said connecting foot stand at a corresponding position of the seat assembly, and then fixedly connecting said connecting foot stand with said seat assembly through a second fixing member and a third fixing member; and attaching said armrest framework to both ends of said seat assembly.

20. The method for assembling a sofa set according to claim 19, wherein said seat unit comprises a seat frame and a back frame, said seat frame comprises a third seat frame rod, and at least one fixing hole I is arranged on said third seat frame rod, and said back frame comprises a third seat frame rod, and at least one fixing hole J is arranged on said third seat frame rod; and said fixing hole J corresponds to said fixing hole I; and wherein, when said seats unit are assembled, said seat plate and said back plate are fixedly connected by a fifth fixing member.

* * * * *